United States Patent [19]

Jentsch

[11] 4,406,646

[45] Sep. 27, 1983

[54] METHOD OF PRODUCING SELF-SUPPORTING PLASTIC BAG

[76] Inventor: Hans G. Jentsch, Daimlerstrasse 4, D-4300 Essen, Fed. Rep. of Germany

[21] Appl. No.: 241,128

[22] Filed: Mar. 6, 1981

[30] Foreign Application Priority Data

Mar. 7, 1980 [DE] Fed. Rep. of Germany ..... 3008809

[51] Int. Cl.[3] ..... B31B 29/00

[52] U.S. Cl. ..... 493/209; 493/936

[58] Field of Search ..... 493/936, 219, 218, 209; 229/58, 57, 61

[56] References Cited

U.S. PATENT DOCUMENTS

| | | | |
|---|---|---|---|
| 1,129,130 | 2/1915 | Shaw | 229/58 |
| 2,853,225 | 9/1958 | Bauer | 229/58 |
| 3,282,411 | 11/1966 | Jardine | 229/57 X |
| 3,387,701 | 6/1968 | Schneider et al. | 229/58 X |
| 4,041,851 | 8/1977 | Jentsch | 493/218 X |

FOREIGN PATENT DOCUMENTS

| | | | |
|---|---|---|---|
| 1557777 | 1/1969 | France | 229/58 |

*Primary Examiner*—James F. Coan

[57] ABSTRACT

A method of producing a synthetic foil flat-bottom bag capable of receiving liquid, fluid or pourable material and capable of standing up-right when filled, in which a bag closed at the bottom and open at the top is spread apart at opposite sides whereby at its bottom, a bottom surface with two outwardly pointed triangular tips is formed. The two tips are compressed flat with their two-foil walls and are folded downwardly by approximately 180° about a fold line laterally spaced from the bottom of the bag, while the tip ends are placed against the underside of the bottom wall. Thereafter the two tip folds are crease-welded. The thus produced bag has a supporting surface which is enlarged by the welded multi-layer folds and is stabilized, and tightly sealed by the crease welds in the area of the tip. The folding of the tip is preferably effected by means of a form plate which has two parallel form edges extending beyond the bottom surface of the bag. Upon folding and prior to crease-welding of the tips the form plate is removed.

10 Claims, 5 Drawing Figures

METHOD OF PRODUCING SELF-SUPPORTING PLASTIC BAG

BACKGROUND OF THE INVENTION

The present invention relates to the manufacture of bags or pouches of synthetic foils, and more specifically, to bags, or pouches of this type which, even if filled with material capable of flowing, such as liquid or granular material, are able to stand up reliably or be self-supporting. The term "synthetic foil" used hereafter includes all synthetic foils customarily used for producing bags, including mono-foils of sealable material, multiple foils with at least one sealable plastic layer, a variety of compound foils with at least one sealable synthetic layer, as well as metallized synthetic foils.

In recent years, bottles, boxes or cannisters have been replaced increasingly by flat-bottom bags that are self-supporting and are made from bendable or flexible synthetic foils. When producing such bags one starts for instance with a bag having a seamless bottom and an open top. This bag is grasped at two opposite flat sides and is spread such that at its lower part a bottom surface and two triangular tip portions are created which protrude outwardly. The tip portions are essentially compressed in the plane of the bottom surface and are provided with a welded seam in the areas immediately adjacent the rectangular bottom surface. In one example illustrated in U.S. Pat. No. 3,435,736, this welded seam extends over the entire area of the tip portion and closes the same completely. According to another example in U.S. Pat. No. 4,041,851 the welded seam of the tip portion is limited to a strip-like area in the immediate vicinity of the bottom surface. Upon completion of the welded seam the tip portions are, along the crease or fold line extending immediately adjacent the bottom surface of the bag, folded against the under side of the bottom surface, and are connected to the surface. When using these known bags for packing liquids, especially for larger quantities, experience has shown that the ability of the bag to stand up or be self-supporting is insufficient. The liquid inside the bag brings about a bulging deformation of the bendable synthetic foil even at the supporting surfaces proper, and thereby lifts the supporting surfaces at the sides. When the approximately triangular tip portions are folded back onto the bottom side of the bottom surface the available supporting surface of the bag is reduced even more and the ability of the bag to stand up is impaired accordingly.

A somewhat better support of the bag results if the tip portions are cut off with the exception of the bottom welded seam adjacent the bottom surface of the bag and if they are left to protrude at an angle outwardly without being folded. In this way, however, the tightness of the bag and the stability in the bottom area is diminished. Such a bag cannot be maintained sufficiently tight for packing liquids, by means of a simple sealing seam along the two cut-off tip portions located opposite each other. The two bottom-welded seams adjacent the bottom welded surface have to be overwelded for a sufficiently tight seal, especially for liquids. This requires an additional manufacturing step, which is described in U.S. Pat. No. 4,041,851 (Jentsch).

It is, therefore, an object of the present invention to provide a flat-bottom bag made of synthetic foil, which is capable of standing up much better compared to similar bags heretofore available and which has an optimum tightness and stability in the area of the bottom. The high self-supporting capability of the bag and optimum tightness and stability thereof in the bottom area are to be accomplished with a minimum of manufacturing expense.

BRIEF SUMMARY OF THE INVENTION

According to the invention, first, from a one-piece blank of synthetic foil, a bag is formed which is closed at the bottom and open at the top. This bag is grasped at two opposite side walls and is spread apart so that at the bottom side of the bag there is formed an essentially flat bottom surface with two outwardly extending double-walled tip portions. These two tip portions are fixedly held approximately in the plane of the bottom surface at a strip-like portion adjacent the bottom surface and the respective side wall. The remaining portion of each tip is thereafter folded by approximately 180° and is placed with the free tip end against the bottom surface from underneath. Thus, each tip portion is formed into a four-walled fold protruding outwardly from the bottom surface. Each of the two four-walled folds is crease-welded thereafter, i.e. each fold is sealed outside the bottom surface between two welding dies engaging the outer surfaces of the fold from the top and bottom. The above term "welding a crease" or crease-welding as used in the remainder of the specification is intended to mean that a plastic foil is folded onto itself in the form of a V or a W and is then welded or fused together without cutting or otherwise damaging the crease. Any interior sealable layers of material are welded together. Thus, a flat-bottom bag is formed which has a supporting surface which is enlarged and stabilized by the welded multi-layer folds and which has folded tip portions which are sealed by additional welding seams and are tightly closed.

By folding over the tip portions prior to welding the crease, in a single welding step the tip portion is closed twice successively by welding seams. One welding seam extends in the upper two-walled arm of the tip portion and the second welding seam parallel thereto and in alignment therewith in the lower two-walled arm of the tip portion. The material of these two welding seams may be fused or welded into a single welding seam if the bag consists of a mono-foil. The four-wall welding of the crease in the area of the tip portion guarantees the highest stability. Because of the two welded bottom folds which protrude outwardly parallel to the bottom surface, the bottom surface is enlarged, considerably strengthened and stabilized. The crease-welding of the two folds outside the bottom surface of the bag has the additional advantage that each folded end of the tip portion is forced into the predetermined position, immediately adjacent the other side of the bottom wall by the fold line reinforced during the welding process and possibly also by the welding seam itself. This pretension of the tip portion ends into the abutment position at the bottom surface is especially strong if the synthetic foil of the bag is sealable on both sides and if the fold is welded or fused with all walls during the welding of the crease.

If, on the other hand, a multi-layer synthetic foil is used with only one sealable layer located on the inside of the bag it may be advantageous to glue the ends of the tip portions in known manner to the underside of the bottom, as for instance disclosed in U.S. Pat. No. 4,041,851.

BRIEF DESCRIPTION OF THE DRAWING

The invention is illustrated, by way of example, in the accompanying drawing in which.

DETAILED DESCRIPTION OF THE INVENTION

Before describing FIGS. 1 to 5 in detail, it should be emphasized that the illustration in these figures is purely schematic and that individual parts have been enlarged to an exaggerated degree in order to better illustrate the invention. The foil material, as mentioned above, may be a single or multilayer synthetic foil or a synthetic metal foil laminate.

Figure 1:
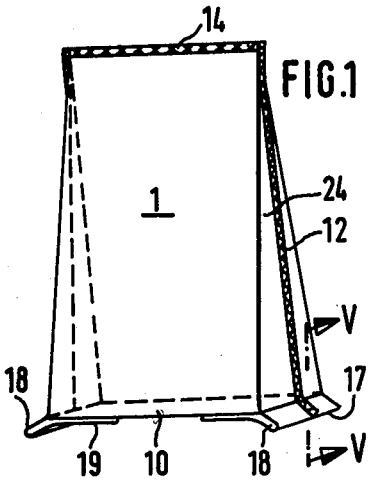
FIG. 1 is a perspective schematic representation of a flat-bottom bag according to one embodiment of the present invention.

The flat-bottom bag 1 schematically illustrated in FIG. 1 in perspective has an essentially rectangular bottom surface 10 from which in the illustrated embodiment two welded seams 12 extend along the sides to the top of the bag (the closing welded seam 14).

Double-walled tip or ear portions 16 extend from the narrower sides of the bottom surface 10. The tip portions are folded back respectively along a fold line 17 spaced outwardly from the bottom surface of the bag, by approximately 180° onto the bottom side of the bottom surface 10 and are welded to form a crease approximately parallel to the fold line 17 in an area located laterally outwardly of the bottom surface of the four-walled fold 18. Due to the folding and welding of the crease the ends 19 of the tip portions 16 are pressed against the underside of the bottom surface 10.

Figure 2:
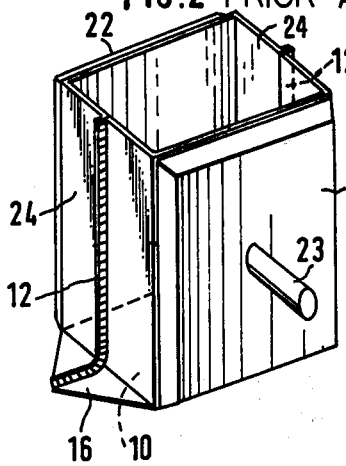
FIG.2 PRIOR ART
FIG. 2 illustrates a customary method step in the production of the bag according to FIG. 1, as for instance disclosed in U.S. Pat. No. 4,041,851.

In the embodiment illustrated in FIGS. 1 and 2 the bottom surface 10 is a seamless, closed surface which, at the two edges parallel to each other turns into the crease-welded folds 18. These folds 18 increase the supporting surface and stabilize the filled bag in view of the fact that they are composed of four walls and thereby are relatively resistant to bending. They are effective in the manner of stabilizing feet protruding laterally beyond the bottom surface 10.

Figure 4:
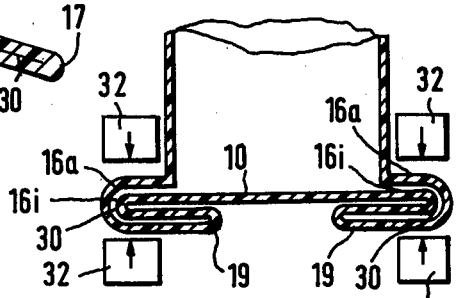
FIG. 4 is an elevational view similar to that of FIG. 3, immediately prior to welding of the folds of the tip portion.
Figure 3:
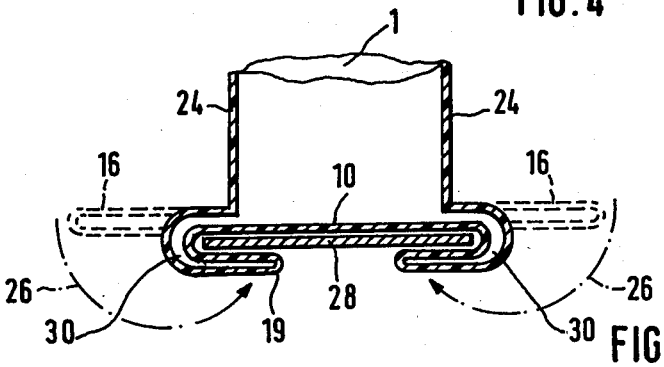
FIG. 3 is a schematic elevational view of the bottom area of the bag in a later method step, after the tip portions have been folded back.

FIGS. 2 to 4 illustrate the essential method steps for producing the bag schematically illustrated in FIG. 1.

According to FIG. 2 one starts from a bag which consists of a blank of foil material which extends from a top edge beyond the essentially rectangular bottom surface 10 without seams to the other upper edge, and which is welded along its two opposite side edges by welded seams 12. The open bag is grasped and pulled apart at its flat sides, for instance by means of suction devices 22, 23 in such a way that at its bottom side the rectangular bottom surface 10 is provided with two outwardly pointing, double-walled tip portions 16. These tip portions extend approximately in the same plane as the bottom surface 10 and perpendicularly to the adjacent side wall 24 of the bag. The spreading of the bag for forming the rectangular bottom surface 10 and the tip portions 16 may be effected in other ways, such as by spreading means effective from inside the bag. Thus far, the invention makes use of the customary method of producing flat-bottom bags, as disclosed for instance in U.S. Pat. No. 4,041,851.

FIGS. 3 and 4 show new method steps according to the present invention, which follow the method steps according to FIG. 2. They are elevational views of the bottom section of bag 1. According to FIG. 3 the tip portions 16 adjoining the bottom surface 10 outwardly are folded in the direction of the arrows 26 onto the underside of the bottom surface 10. For this purpose, the bottom surface 10 of bag 1 is supported centrally by a flat form plate 28 which has outer edges protruding laterally from, and parallel to the bottom surface so as to form edges when folding over the tip portions 16. After removal of the form plate 28, the four-walled folds 30 shown in FIG. 4 are formed. They consist of the two walls of the tip portion 16 extending approximately in the direction of the bottom surface 10 and of the two walls of tip end sections 19 folded by 180° downwardly about the plate 28. The space between the walls starting from the sidewalls 24 and the walls extending from the bottom surface 10, is exaggerated in FIGS. 3 and 4 in order to clearly show that the folds 30 consist of four walls.

After folding back the tip portions 16 the four-walled folds 30 are welded or fused to form a crease, by means of welding dies 32. The welding dies 32, in the illustrated example, approach the folds 30 in a direction normal to the plane of the bottom surface 10 and weld the four sections protruding outwardly adjacent the bottom surface 10 in such a way that between the sealable inner walls of the respectively outer and inner walls **16*a* and 16*i* two continuous weld seams are formed, of which one is formed in the section of the tip portion merging into the bottom surface and the other is formed in the section 19 of the tip portion folded under the bottom surface. Simultaneously, with the crease-welding of the folds 30 a more pronounced fold line 17 is formed at the outer edge of each fold 30. In this way, each tip portion 16 is reliably closed by successively arranged parallel weld seams and by a folded crease 17 lying therebetween. Thus, a hermetic seal is achieved in the area where the sidewall 24 of the bag merges or turns into the bottom surface 10**.

FIG. 4 clearly shows that the folds 30 of the bag 10 form a stable and wide supporting surface.

Figure 5:
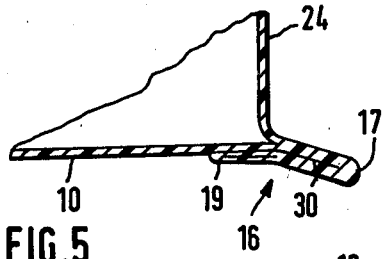
FIG. 5 is a schematic section through a fold in the tip portion after welding, taken along line V—V in FIG. 1.

During production, the bags 1 are preferably moved perpendicularly to the plane of the drawing of FIGS. 3 and 4, i.e. slid onto the form plate 28 and after forming the folds are slid off the form plate and transported in-between the welding dies 32. The welding dies 32, instead of being moved normally to the plane of the bottom surface 10, may also be moved at an angle with respect thereto so that the folds 30 after welding the crease may for instance extend in a direction outwardly and downwardly, as shown for instance in FIG. 5. FIG. 5 is a section through the area of the tip portion 16 of the bag after crease-welding of the fold 30. The elevational section according to FIG. 5 is taken along the line V—V in FIG. 1, as seen in the direction of the fold line 17. This view shows that in the area of the crease welded fold 30 the outer and inner walls (**16*a*, 16*i*, FIG. 4) resting on each other with internal surfaces during crease welding are fused or welded together in the upper region of fold 30 as well as also in the lower area belonging to the tip section 19. By contrast, the lower surface of the upper wall and the upper surface of the lower wall do not fuse to each other when welding the fold 30, since in the example illustrated in FIG. 5**, the particular synthetic foil used has a material on its outer surface which is non-sealable.

If the synthetic foil used consists also on the outside of sealable material a welded connection is formed between all engaging layers of the fold 30, which will lead to an additional stabilization of the fold 30 and will result in a pretension in the free end of the tip section 19 against the bottom side of the bottom wall 10. Alternatively, the free end 19 may also be glued to the underside of the bottom wall 10.

It will be obvious to an expert in this field that the invention is not limited to the particular embodiment illustrated in the drawing but that several modifications are possible within the scope of the appended claims.

I claim:

1. A method for producing a self-supporting bag of synthetic foil, comprising the steps of:

(a) forming a bag seamlessly closed at its bottom and open at the top;

(b) grasping two oppositely located side walls of the bag and moving the same apart such that at the bottom of the bag an essentially flat and seamless bottom surface with two outwardly extending double-walled tip portions is formed;

(c) holding a strip-like portion of each tip portion bordering the bottom surface substantially in the plane of the bottom surface;

(d) folding the remainder of the tip portion by about 180° and placing the free end of the tip portion from underneath against the bottom surface, to thereby form a four-walled fold protruding outwardly from the bottom surface; and (e) welding each four-walled fold for defining a strip-like welded crease section located laterally outside the bottom surface, whereby a flat-bottom bag is formed which has a supporting surface enlarged by the welded multi-walled folds and stabilized and which has tightly closed tip portions.

2. The method according to claim 1, in which during said step of holding the strip-like portions, the bottom surface and said strip-like portions are held against an essentially flat abutment surface of a form plate, the abutment surface being confined on two opposite sides by parallel side edges the spacing of which is approximately equal to the width of the bottom surface plus the width of the two strip-like portions.

3. The method according to claim 2, in which the tip portion ends protruding outwardly are placed about the respective parallel side edge of the form plate and are moved in a direction towards a surface of the form plate opposite said abutment surface for forming said four-walled folds, and in which upon removal of the form plate the two four-walled folds are formed and welded in the region of the folds outwardly protruding beyond the bottom surface of the bag to thereby define two strip-like welded crease sections.

4. The method according to claim 3, in which the form plate and the bag are separated from each other, upon folding of the tip portions, by relative movement parallel to the bottom surface.

5. The method according to claim 1 or 3, in which the crease line where the end of each tip portion is folded, is pressed flat during welding such that the tip end is pretensioned against the bottom side of the bottom surface of the bag.

6. The method according to claim 1, comprising: welding the bottom folds with welding dies, said dies being moved substantially at right angles with respect to the plane of the bottom surface, said dies engaging the folds from above and from below and pressing the same flat.

7. A method of producing a bag of synthetic foil, with a seamless bottom wall serving as a supporting surface and side walls surrounding the interior space of the bag, comprising the steps of:

(a) folding two halves of a one-piece foil blank such that the foil extends from an upper edge of the bag via the bottom wall to another upper edge without seams;

(b) welding the superimposed foil sections along spaced side margins to form side seams extending to the upper edges to thereby forming a bag open only at the upper edges;

(c) spreading the bag apart so as to form an essentially flat bottom wall, four side walls confining the interior of the bag, and outwardly extending approximately triangular tips, the side seams each extending up to the outer end of the tips;

(d) folding each free tip end by approximately 180° by tilting the tip end about a fold line which is located respectively laterally outwardly and in spaced relationship to the adjacent side wall, to thereby form two strip-like folds protruding outwardly beyond two opposite side surfaces of the bag; and (e) crease-welding the thus formed two folds by welding dies which engage each fold over its entire width on its outer surface from the top and the bottom, to thereby form a flat-bottom bag which has a supporting surface enlarged and stabilized by welded, multi-walled folds and has tightly closed tips.

8. The method according to claim 7, in which the two tip ends are folded downwardly such that each fold of the respective tip has a first arm extending from the adjacent side surface of the bag outwardly to the fold line and a second arm extending from the fold line below the first arm up to the end of the tip, and wherein the first arm is shorter than the second arm so that the tip ends below the bottom wall.

9. The method according to claim 8, in which each of the two arms of each fold consists of two loosely engaging foil walls, and in which the two foil walls of each arm are sealed by a weld seam extending parallel to the respective fold line, whereby the two welded seams in the two arms belonging to the same fold are aligned with each other.

10. The method according to claim 9, in which the foil material is sealable on both its surfaces and in which the two arms of each fold during crease-welding are welded to each other along the common crease-welded seam, and wherein the non-welded tip ends are pressed against the underside of the bottom wall of the bag.

* * * * *